US011346373B2

(12) United States Patent
Berkel et al.

(10) Patent No.: US 11,346,373 B2
(45) Date of Patent: May 31, 2022

(54) HYDRO-PNEUMATIC ACCUMULATOR WITH INTEGRATED NITROGEN PRECHARGE REGENERATION SYSTEM

(71) Applicant: Parker-Hannifin Corporation, Cleveland, OH (US)

(72) Inventors: Edward Berkel, Cypress, TX (US); Rafael Alberto Toledo, Rockford, IL (US); William Mark Mosher, Rockford, IL (US); Bruce Besch, Andover, MN (US); Kevin Koenigs, Prairie View, IL (US); David Connaughton, Hampton, NH (US)

(73) Assignee: Parker-Hannifin Corporation, Cleveland, OH (US)

( * ) Notice: Subject to any disclaimer, the term of this patent is extended or adjusted under 35 U.S.C. 154(b) by 563 days.

(21) Appl. No.: 16/348,323

(22) PCT Filed: Jan. 10, 2018

(86) PCT No.: PCT/US2018/013051

§ 371 (c)(1),
(2) Date: May 8, 2019

(87) PCT Pub. No.: WO2018/132399

PCT Pub. Date: Jul. 19, 2018

(65) Prior Publication Data

US 2021/0285465 A1 Sep. 16, 2021

Related U.S. Application Data

(60) Provisional application No. 62/444,533, filed on Jan. 10, 2017.

(51) Int. Cl.
*F15B 1/08* (2006.01)

(52) U.S. Cl.
CPC ..... *F15B 1/08* (2013.01); *F15B 2201/205* (2013.01); *F15B 2201/4155* (2013.01); *F15B 2201/51* (2013.01); *F15B 2201/515* (2013.01)

(58) Field of Classification Search
CPC .. F15B 1/08; F15B 2201/205; F15B 2201/51; F15B 2201/515; F15B 2201/4155
See application file for complete search history.

(56) References Cited

U.S. PATENT DOCUMENTS 4,428,401 A * 1/1984 Chun ..... F15B 1/08 138/30
2009/0165451 A1 7/2009 Mueller et al.
2014/0053640 A1 2/2014 Jirgal

FOREIGN PATENT DOCUMENTS

WO WO 2010/087934 A1 8/2010
WO WO 2010/097153 A1 9/2010

OTHER PUBLICATIONS

International Search Report of PCT/US2018/013051 dated Jun. 6, 2018.

* cited by examiner

*Primary Examiner* — F Daniel Lopez
(74) *Attorney, Agent, or Firm* — Renner, Otto, Boisselle & Sklar, LLP

(57) ABSTRACT

A pressure accumulator includes an accumulator housing having first and second ports for receiving first and second pressure mediums, respectively, a movable separating element subdividing an interior of the accumulator housing into at least first and second working spaces, the first working space accommodating the first pressure medium and the second working space accommodating the second pressure medium, wherein the first port is in fluid communication with the first working space and the second port in fluid communication with the second working space. At least one (Continued)

sensor is operatively coupled to the first working space for measuring at least one characteristic of the first working space, and a gas generator is operative to generate a gas from ambient air, the gas generator including an outlet for outputting the generated gas, the outlet in fluid communication with the first port. A controller is operatively coupled to the at least one sensor and the gas generator, the controller configured to calculate an amount of gas in the first working space based on the at least one characteristic and upon the calculated amount of gas in the first working space being below a first threshold level, generate a command to introduce gas from the gas generator into the first working space.

18 Claims, 3 Drawing Sheets

HYDRO-PNEUMATIC ACCUMULATOR WITH INTEGRATED NITROGEN PRECHARGE REGENERATION SYSTEM

RELATED APPLICATION DATA

This application is a national stage application pursuant to 35 U.S.C. § 371 of PCT/US2018/013051 filed on Jan. 10, 2018, which claims the benefit of U.S. Provisional Application No. 62/444,533 filed Jan. 10, 2017, the contents of which are incorporated herein by reference.

FIELD OF THE INVENTION

The present invention relates generally to hydro-pneumatic accumulators and, more particularly, to a device and method for automatically replenishing a gas pre-charge of a hydro-pneumatic accumulator.

BACKGROUND OF THE INVENTION

Hydro-pneumatic accumulators operate on the principle that energy may be stored by compressing a gas. A hydro-pneumatic accumulator's pressure vessel contains a captive charge of inert gas, typically nitrogen, which becomes compressed as a hydraulic pump pumps liquid into the accumulator, or during regenerative braking processes where the braking effect charges liquid into the accumulator. The fluid, when released from the accumulator, may be used to drive a hydraulic motor to propel a vehicle, for example. Typically, operating pressures for such systems may be between 100 psi to greater than 7,000 psi, for example.

Typical hydro-pneumatic accumulators include bladders or pistons with seals which separate the hydraulic fluid from the inert gas. The gases tend to slowly escape through the bladders and seals, resulting in continual loss of pressure. This requires periodic servicing to replenish the gas supply to maintain or restore proper performance.

SUMMARY OF THE INVENTION

The present invention provides a device and method that monitors a gas pre-charge of an accumulator and automatically replenishes the gas level when the level is determined to be below a threshold level. To monitor the gas pre-charge, one or more sensors measure a pressure, temperature, volume, flow, and/or weight of a gas in the gas-side of the accumulator and, based on the one or more parameters, a mass of the pre-charge gas is calculated. If the mass of the pre-charge gas is below a prescribed threshold value, a command is generated that instructs a gas generator of the accumulator, such as a nitrogen gas generator or the like, to scrub gas (e.g., nitrogen) from the air (e.g., ambient air, pressurized air or other air source). The gas then is processed through a pump/intensifier and introduced into the accumulator in order to bring the gas level back up to a target level.

According to one aspect of the invention, a pressure accumulator includes an accumulator housing having first and second ports for receiving first and second pressure mediums, respectively; a movable separating element subdividing an interior of the accumulator housing into at least first and second working spaces, the first working space accommodating the first pressure medium and the second working space accommodating the second pressure medium, wherein the first port is in fluid communication with the first working space and the second port in fluid communication with the second working space; at least one sensor operatively coupled to the first working space for measuring at least one characteristic of the first working space; a Nitrogen gas generator operative to generate a Nitrogen gas from a source of air, the Nitrogen gas generator including an outlet for outputting the generated Nitrogen gas, the outlet in fluid communication with the first port; and a controller operatively coupled to the at least one sensor and the Nitrogen gas generator, the controller configured to compare the at least one sensed characteristic to a predetermined threshold level of the characteristic, and based on the comparison generate a command to introduce Nitrogen gas from the Nitrogen gas generator into the first working space.

According to another aspect of the invention, a pressure accumulator includes an accumulator housing having first and second ports for receiving first and second pressure mediums, respectively; a movable separating element subdividing an interior of the accumulator housing into at least first and second working spaces, the first working space accommodating the first pressure medium and the second working space accommodating the second pressure medium, wherein the first port is in fluid communication with the first working space and the second port in fluid communication with the second working space; at least one sensor operatively coupled to the first working space for measuring at least one characteristic of the first working space; a Nitrogen gas generator operative to generate a Nitrogen gas from a source of air, the Nitrogen gas generator including an outlet for outputting the generated Nitrogen gas, the outlet in fluid communication with the first port; and a controller operatively coupled to the at least one sensor and the Nitrogen gas generator, the controller configured to calculate an amount of Nitrogen gas in the first working space based on the at least one characteristic, upon the calculated amount of Nitrogen gas in the first working space being below a first threshold level, generate a command to introduce Nitrogen gas from the Nitrogen gas generator into the first working space.

Optionally, at step 112 of FIG. 3, the controller is configured to: determine a deficiency of the Nitrogen gas in the first working space based on the calculated amount of Nitrogen gas in the first working space and a target amount of Nitrogen gas for the first working space; determine a rate at which the Nitrogen gas generator charges Nitrogen gas into the first working space; and determine an amount of time to command the Nitrogen gas generator to introduce Nitrogen gas into the first working space based on the determined deficiency of the Nitrogen gas in the first working space and the determined rate at which the Nitrogen gas generator charges gas into the first working space.

Optionally, at step 108 of FIG. 3, the controller is configured to determine the rate at which the Nitrogen gas generator charges Nitrogen gas into the first working space based on a measured pressure of the Nitrogen gas in the first working space and a pressure of the Nitrogen gas output by the Nitrogen gas generator.

Optionally, the Nitrogen gas generator is mounted on the accumulator.

Optionally, the Nitrogen gas generator comprises a nitrogen scrubber operative to extract nitrogen from air.

Optionally, the Nitrogen gas generator comprises an intensifier operative to raise a pressure of the Nitrogen gas.

Optionally, the intensifier comprises a compressor.

Optionally, the controller is operatively coupled to the Nitrogen gas generator to provide the command to the Nitrogen gas generator to generate Nitrogen gas, and the Nitrogen gas generator is configured to be responsive to the command to generate Nitrogen gas and provide the generated Nitrogen gas to the outlet of the Nitrogen gas generator.

Optionally, the at least one sensor comprises at least one of a temperature sensor operative to measure a temperature of the first pressure medium, a pressure sensor operative to measure a pressure of the first pressure medium, or a position sensor operative to measure a position of the moveable separating element within the accumulator housing, and wherein the controller, based on data provided by the at least one sensor, is configured to, at step 106 in FIG. 3, calculate at least one of a volume of the first working space, a mass of the first pressure medium, a temperature of the first pressure medium, a pressure of the first pressure medium.

Optionally, the at least one sensor comprises a temperature sensor operative to measure a temperature of the first pressure medium in the first working space.

Optionally, the pressure accumulator includes a check valve between the accumulator and the Nitrogen gas generator.

Optionally, the at least one sensor comprises a pressure sensor operative to measure a pressure of the first pressure medium in the first working space.

Optionally, the at least one sensor comprises a position sensor operative to measure a position of the movable separating element within the accumulator housing, and wherein the controller is configured to, at step 106 in FIG. 3, calculate a volume of the first working space based on the measured position of the moveable separating element.

According to another aspect of the invention, a method for replenishing a pre-charge Nitrogen gas of an accumulator is provided, the accumulator including a first working space for storing the pre-charge Nitrogen gas and a second working space for receiving a fluid. The method includes: at step 124 of FIG. 4, sensing a pressure of the pre-charge Nitrogen gas in the first working space; at step 128 of FIG. 4, comparing the sensed pressure to a prescribed threshold pressure; at step 134 of FIG. 4, upon the sensed pressure being less than the prescribed threshold sensed pressure, using a Nitrogen gas generator to extract a Nitrogen gas corresponding to the pre-charge gas from the air, and charge the extracted Nitrogen gas into the first working space.

According to another aspect of the invention, a method for replenishing a pre-charge Nitrogen gas of an accumulator is provided, the accumulator including a first working space for storing the pre-charge gas and a second working space for receiving a fluid. The method includes: calculating a mass of the pre-charge Nitrogen gas in the first working space; comparing the calculated mass to a prescribed threshold mass; upon the calculated mass being less than the prescribed threshold mass, using a Nitrogen gas generator to extract a gas corresponding to the pre-charge Nitrogen gas from the air, and charge the extracted Nitrogen gas into the first working space.

Optionally, comparing includes: at step 108 of FIG. 3, determining a deficiency in the amount of the Nitrogen gas in the first working space based on the calculated mass and a target mass for the Nitrogen gas in first working space; determining a rate at which the Nitrogen gas generator charges the Nitrogen gas into the first working space; and determining an amount of time to activate the Nitrogen gas generator to charge the Nitrogen gas into the first working space based on the determined deficiency in the amount of the Nitrogen gas in the first working space and the determined rate at which the Nitrogen gas generator charges the Nitrogen gas into the first working space.

Optionally, at step 108 of FIG. 3, determining the rate at which the Nitrogen gas generator charges the Nitrogen gas into the first working space includes basing the rate on a measured pressure of the Nitrogen gas in the first working space and a pressure of the Nitrogen gas output by the Nitrogen gas generator.

Optionally, at step 106 of FIG. 3, determining the mass of the Nitrogen gas comprises: determining a volume of the first working space; determining a pressure of the Nitrogen gas in the first working space; determining a temperature of the Nitrogen gas in the first working space; and determining the mass of the Nitrogen gas based on the determined volume of the first working space, the pressure of the Nitrogen gas in the first working space, and the temperature of the Nitrogen gas in the first working space.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

Many aspects of the invention in accordance with the present disclosure can be better understood with reference to the following drawings. The components in the drawings are not necessarily to scale, emphasis instead being placed upon clearly illustrating the principles in accordance with the present disclosure. Likewise, elements and features depicted in one drawing may be combined with elements and features depicted in additional drawings. Additionally, in the drawings, like reference numerals designate corresponding parts throughout the several views.

DETAILED DESCRIPTION

Figure 1:
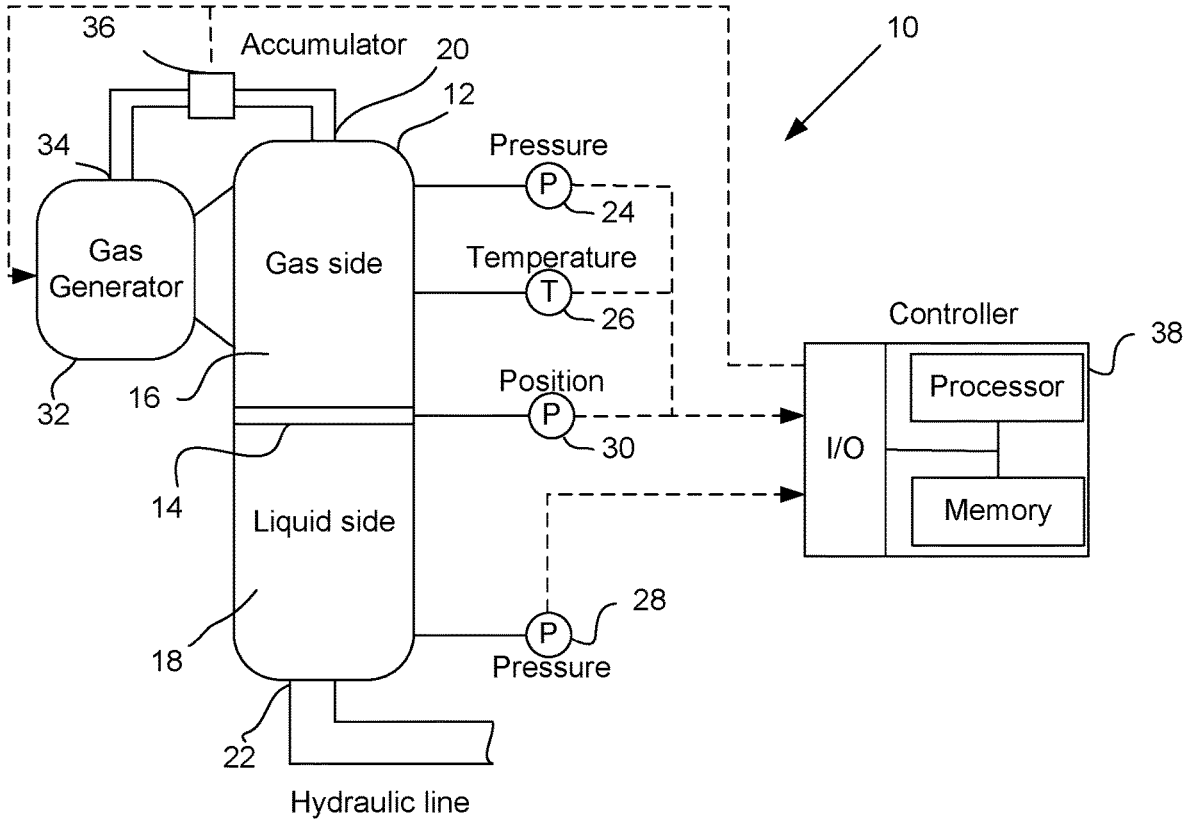
FIG. 1 is a block diagram of an exemplary hydro-pneumatic accumulator in accordance with the invention.

Turning now to the drawings in detail, and initially to FIG. 1, an exemplary system 10 for automatically replenishing a pre-charge of an accumulator is illustrated. As used herein, "replenish" the pre-charge in the accumulator is defined as adding to the pre-charge in the accumulator. In the typical case, this would include adding gas to the gas already existing in the accumulator. In the worst case, this can include a complete refill of the pre-charge gas in the accumulator (e.g., when the accumulator pre-charge is completely empty). The term "replenish" may be used interchangeably with "recharge" and "refill".

The system 10 includes and accumulator 12 having a housing with a generally elongate shape. A movable separating element 14, such as a piston, bladder, or the like, is supported within the accumulator 12 and is displaced axially during pressurization/depressurization of the accumulator 12. The separating element 14 subdivides an interior of the accumulator housing into at least first 16 and second 18 working spaces, the first working space 16 accommodating a first pressure medium (e.g., a gas, such as nitrogen) and the second working space 18 accommodating a second pressure medium (e.g., a liquid). The housing includes a first port 20 at one end for receiving a first pressure medium, such as high pressure nitrogen, and second port 22 at the opposite end for receiving a second pressure medium, such as a hydraulic fluid. The first port 20 is in fluid communication with the first working space 16 and the second port 22 is in fluid communication with the second working space 18.

The system 10 also includes at least one sensor operatively coupled to the first working space 16 for measuring at least one characteristic of the first working space. As used herein, measuring a characteristic of the first working space includes measuring physical characteristics of the first working space, such as a volume, as well as measuring characteristics of a gas inside the first working space, e.g., a temperature or pressure of a gas in the first working space.

For example, the at least one sensor may be a pressure sensor 24 that measures a pressure of the gas within the first working space 16 and/or a temperature sensor 26 that measures a temperature of the gas within the first working space 16. One or more sensors may also be operatively coupled to the second working space 18 for measuring at least one characteristic of the second working space. For example, a pressure sensor 28, a temperature sensor (not shown) and/or a flow sensor (not shown) may be operatively coupled to the second working space 18 to measure a pressure of the fluid in the second working space 18, a temperature of the fluid in the second working space 18, and/or a flow of fluid into and/or out of the second working space 18.

Additionally, a position sensor 30 can be operatively coupled to the separating element 14 and operative to measure an axial position of the separating element 14 within the housing. The position sensor 30 may be in the form of a linear variable differential transformer (LVDT), or any other type of sensor that can provide an indication of a position.

The system 10 also includes a gas generator 32 for generating a gas, such as nitrogen, for use as the first pressure medium. The gas generator 32, which may be mounted on the accumulator, includes an outlet 34 for outputting the gas, the outlet in fluid communication with the first port 20 of the accumulator 12 via a valve 36 (e.g., a check valve, solenoid controlled valve or the like). Valve 36 selectively couples/decouples the gas generator 32 from the accumulator 12 in order to enable the gas pre-charge of the accumulator to be replenished with gas from the gas generator 32. Thus, for example, when the valve 36 is open gas generated by the gas generator 32 can be used to replenish the first working space 16, and when the valve 36 is closed the first working space 16 is isolated from the gas generator 32.

A controller 38 is operatively coupled to the sensors 24, 26, 28 and 30, the gas generator 32 and the valve 36 in order to control operation of the system. The controller 38 includes a processing device, such a microprocessor or the like, and memory, such as volatile and non-volatile memory, for storing and retrieving data. The controller 38 also includes input/output (I/O) circuitry for receiving data (e.g., data from the sensors) and outputting commands (e.g., commands to the gas generator 32 and valve 36).

The controller 38 is configured to determine an amount of gas in the first working space 16 based on the at least one characteristic as determined from the one or more sensors. For example, the controller 38, based on data provided by the position sensor 30 and the known dimensions of the accumulator 12, can calculate a volume of the first working space 16. Additionally, the controller 38, based on the calculated volume and measured pressure and temperature, can calculate a mass of the gas in the first working space 16. As described in more detail below, the calculated mass of the gas then can be compared to a threshold level to determine if the first working space 16 should be replenished.

The controller 38, upon determining the mass of the gas in the first working space is below a first threshold level, generates a command for the gas generator 32 to generate gas and to introduce gas from the gas generator 32 into the first working space 16. For example, the command may include a first command that instructs the gas generator 32 to generate gas, and a second command that instructs the valve 36 to open thus coupling the gas generator outlet 34 with input port 20 of the accumulator 12. Alternatively, a single command may be used to operate both the gas generator 32 and the valve 36. The gas generator 32 and valve 36 are configured to be responsive to the command from the controller 38 to generate gas and provide the generated gas to the outlet 34 of the gas generator 32.

Figure 2:
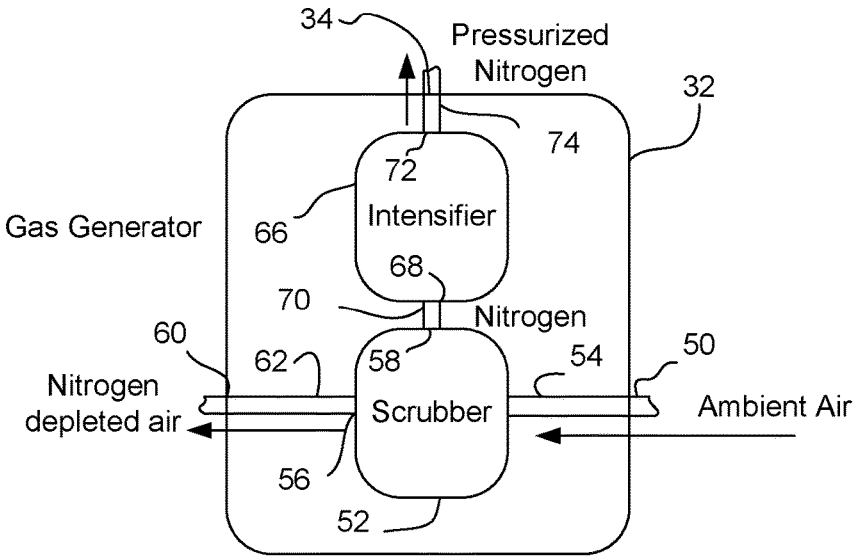
FIG. 2 is a block diagram illustrating an exemplary gas generator that can be used to generate a gas for a working space of a hydro-pneumatic accumulator in accordance with the invention.

With additional reference to FIG. 2, illustrated is an exemplary nitrogen gas generator 32 that may be used in accordance with the invention. The gas generator 32, which may also be referred to as a nitrogen gas scrubber, enriches the nitrogen content in the generated gas. Preferably, the gas generator 32 provides an enriched nitrogen gas having a nitrogen purity level of 80 percent, and more preferably a nitrogen purity level of at least 95 percent nitrogen.

The gas generator 32 includes an inlet 50 for receiving air (e.g., ambient air, pressurized air, or other air source), the inlet 50 being coupled to a scrubber 52 via a conduit 54. The scrubber 52 is operative to scrub nitrogen from the received air using, for example, a membrane or other material that removes nitrogen from the received air to generate nitrogen and nitrogen-depleted air. The nitrogen-depleted air is output from a first output port 56 of the scrubber 52 and nitrogen is output from a second output port 58 of the scrubber 52. The first output port 56 is coupled to an exhaust port 60 of the gas generator 32 via conduit 62, where the nitrogen-depleted air it is vented to the ambient air.

The nitrogen scrubbed from the received air and output at the second output port 58 is generally at atmospheric or low (less than 150 psi) pressure and thus is not at a pressure suitable for charging the accumulator 12. In order to bring the nitrogen up to a pressure suitable for charging the accumulator 12, an intensifier 66, such as a compressor or the like, is used to raise a pressure of the gas to a satisfactory pressure level. In this regard, the second output port 58 of the scrubber 52 is coupled to an input port 68 of the intensifier 66 via conduit 70. The intensifier 66 compresses the nitrogen to a pressure that is suitable for charging the accumulator 12. For example, the intensifier 66 may compress the nitrogen to 7000 PSI, which is then available at an output port 72 of the intensifier. The high-pressure nitrogen then is output from the output port 34 of the gas generator 32 via a conduit 74 connected to the output port 72 of the intensifier.

Figure 3:
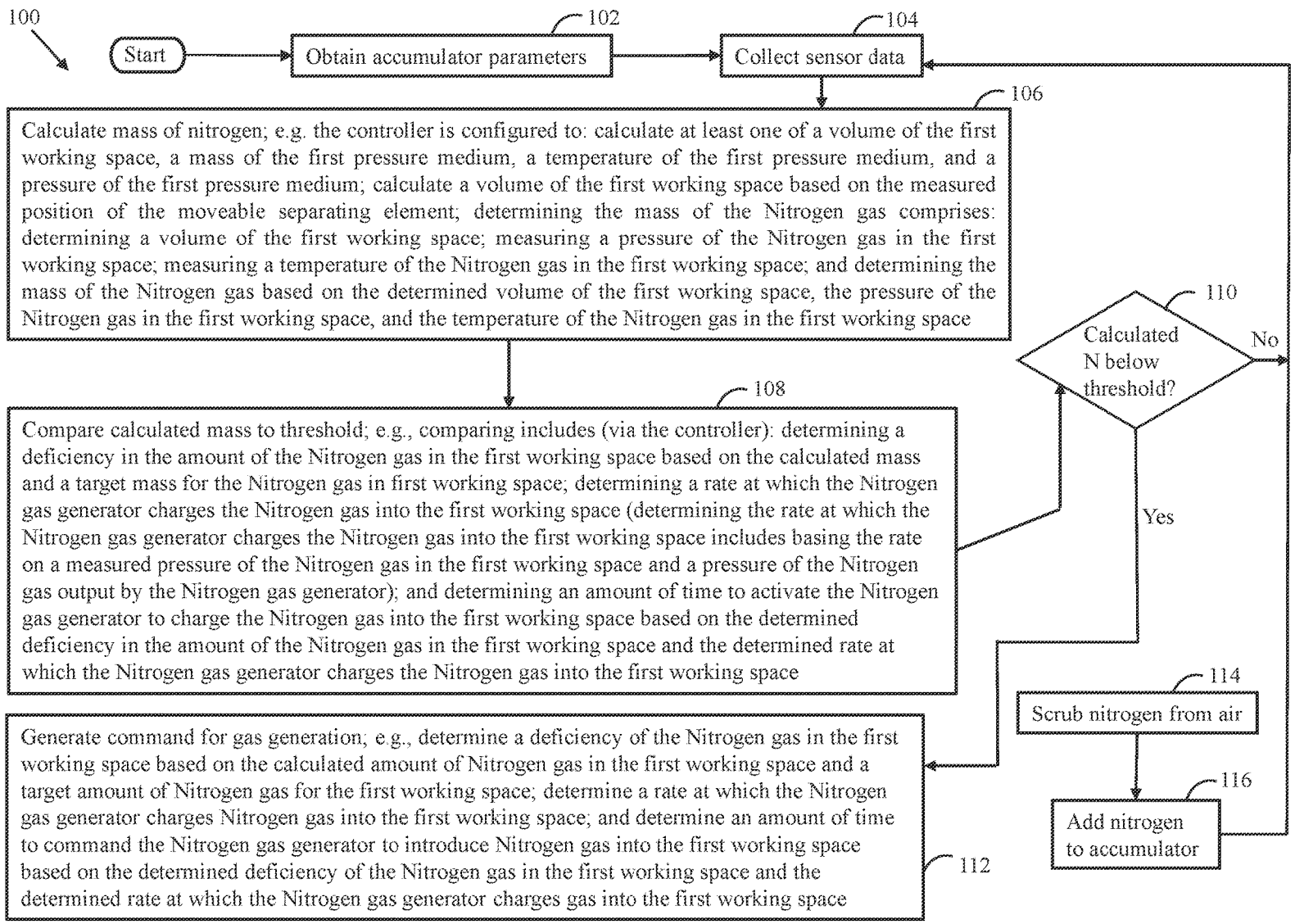
FIG. 3 is a flow chart illustrating exemplary steps of a method for recharging/replenishing a hydro-pneumatic accumulator in accordance with the present invention.

Referring to FIG. 3, illustrated is a flow chart showing an exemplary method 100 for replenishing the pre-charge gas of an accumulator in accordance with the present invention. The method 100 may be executed, for example, by the controller 38 described with respect to FIG. 1. The memory or other circuitry of the controller 38 may include a pre-charge module configured to execute the method described herein.

Beginning at step 102, the controller 38 obtains parameters of the accumulator 12. For example, the physical parameters of the accumulator 12 may be retrieved from memory of the controller 38. These parameters can include, for example, a minimum and maximum volume of the first and second working spaces 16 and 18, travel limits for the moveable separator 14, maximum, nominal and minimum pressures for the first pressure medium (i.e., the gas pre-charge) in the first working space 16, etc. As described below, such information can be used to calculate a mass of the first pressure medium in the first working space 16 and whether or not the first pressure medium in the first working space 16 should be replenished.

Next at step 104 sensor data is collected by the controller 38. For example, the controller 38 may read one or more of a temperature of the first pressure medium, a pressure of the first pressure medium, a position of the movable separating element 14, etc. Such data may be collected by the controller 38 via the I/O module using conventional techniques.

At step 106 the controller 38 calculates the mass of the first pressure medium. In calculating the mass, the volume of the first working space 16 may be calculated based on the position of the movable separating element 14 and the known dimensions of the accumulator 12. For example, the sensor data may indicate the movable separating element 14 is at the mid-point of its travel, (which indicates the volume of the first working space 16 is half of the volume of the accumulator 12). Based on the known dimensions of the accumulator as retrieved during step 102 and the position of the separating element 14, the actual volume of the first working space 16 can be determined. Based on characteristics of the first pressure medium, the calculated volume of the first working space 16, and the measured pressure and temperature of the first pressure medium, the mass of the first pressure medium can be calculated.

Next at step 108 the calculated mass of the first pressure medium is compared to a minimum mass threshold. The minimum mass threshold may be one of the parameters stored in memory of the controller 38 and retrieved at step 102. Alternatively, the minimum mass threshold may be read by the controller 38 from an input device, such as a thumbwheel switch or other input device. Upon comparing the calculated mass of the first pressure medium to the minimum mass threshold, the method moves to step 110.

If at step 110 the calculated mass of the first pressure medium is not less than the minimum mass threshold, then no gas need be added to the accumulator 12 and the method moves back to step 104 and repeats. However, if the calculated mass of the first pressure medium is less than the minimum mass threshold, then a replenish operation is performed at steps 112-116.

In performing the replenish operation, a calculation may be performed to determine how much gas should be added to the accumulator. Such calculation can be based on the deficiency of the first pressure medium in the first working space 16 in combination with a known charge rate of the gas generator 32 and a nominal mass for the first pressure medium in the first working space 16. For example, based on a measured pressure of the first pressure medium and a known pressure output of the gas generator 32, it may be determined that the gas generator 32 can output 2 ounces of gas per second. Further, while the minimum threshold may be ten pounds, a nominal threshold may be slightly higher, e.g., ten pounds, four ounces. If the calculated mass of the first pressure medium is nine pounds, eight ounces, then the mass is twelve ounces below the nominal value. The controller 38, in order to have the mass of the first pressure medium reach the nominal value, can command the gas generator 32 and valve 36 to charge the first working space 16 for six seconds (the replenish time), thereby introducing about twelve ounces of the first pressure medium into the first working space 16.

At step 112, the controller 38 generates a command instructing the gas generator 32 to produce gas for replenishing the accumulator and for the valve 36 to open so as to enable gas to flow from the gas generator to the accumulator. The command is output by the controller 38 via the I/O module. In response to the command from the controller 38, the gas generator 32, for example, begins scrubbing nitrogen from the received air and pressurizing the nitrogen to a level suitable for charging to the accumulator 12. At step 116 the high-pressure nitrogen is charged into the accumulator 12 so long as it is provided with the command from the controller 38. Once the time of the charge corresponds to the determined replenish time, the controller 38 may remove the charge command, at which point the valve 36 closes and the gas generator 32 stops generating gas. The method then may move back to step 104 and repeats.

Figure 4:
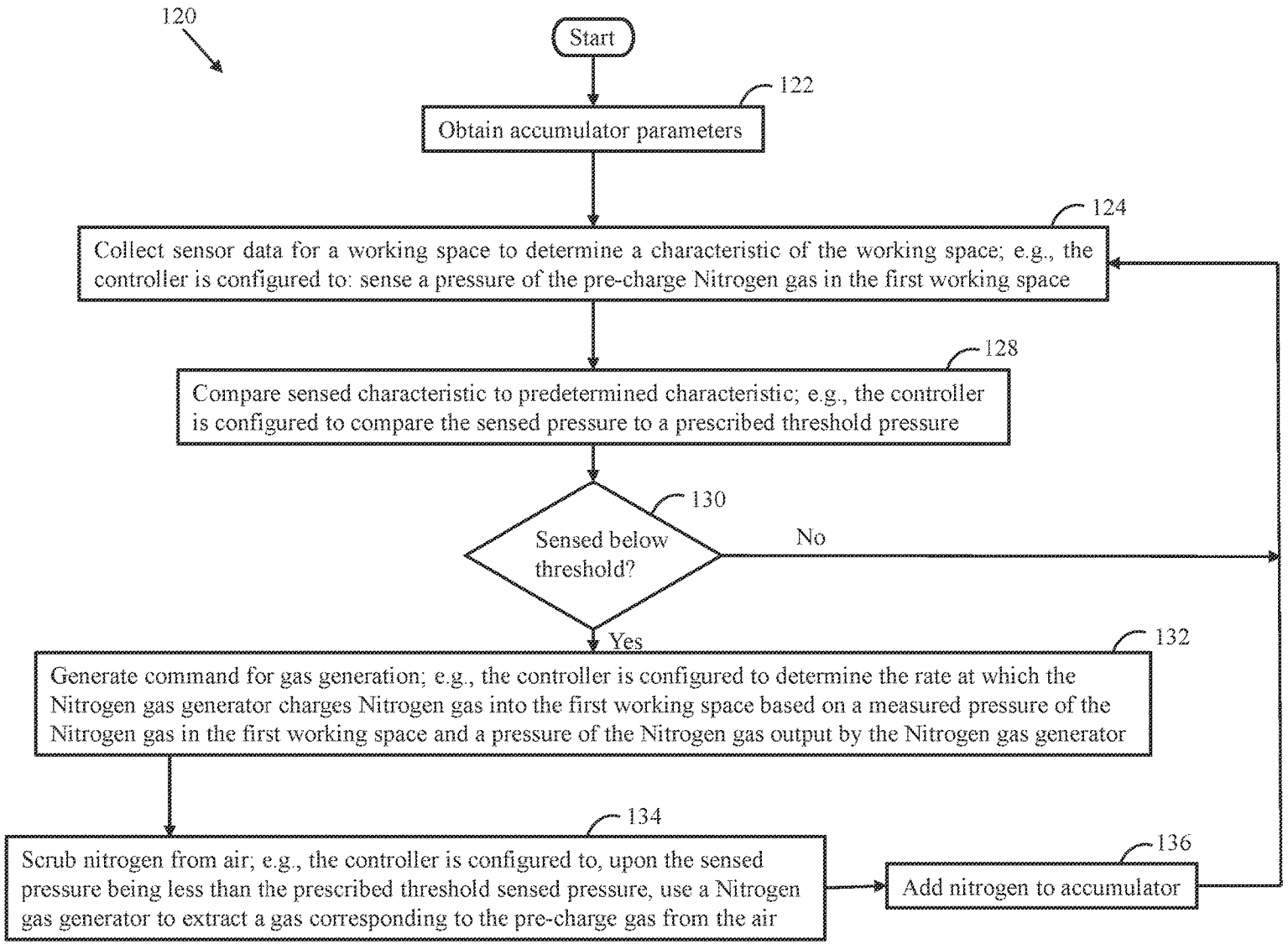
FIG. 4 is a flow chart illustrating exemplary steps of another method for recharging/replenishing a hydro-pneumatic accumulator in accordance with the present invention.

Referring to FIG. 4, illustrated is a flow chart showing another exemplary method 120 for replenishing the pre-charge gas of an accumulator in accordance with the present invention. The method 120 is similar to the method 100 of FIG. 3 and also may be executed by the controller 38 described with respect to FIG. 1. The memory or other circuitry of the controller 38 may include a pre-charge module configured to execute the method described herein.

Beginning at step 122, the controller 38 obtains parameters of the accumulator 12. For example, the physical parameters of the accumulator 12 may be retrieved from memory of the controller 38. These parameters can include, for example, a minimum and maximum volume of the first and second working spaces 16 and 18, travel limits for the moveable separator 14, maximum, nominal and minimum pressures for the first pressure medium (i.e., the gas pre-charge) in the first working space 16, etc. As described below, such information, in combination with a sensed characteristic of the working space, can be used to determine whether or not the first pressure medium in the first working space 16 should be replenished.

Next at step 124 sensor data corresponding to a characteristic of the working space is collected by the controller 38. For example, the controller 38 may read one or more of a temperature of the first pressure medium, a pressure of the first pressure medium, a position of the movable separating element 14, etc. Such data may be collected by the controller 38 via the I/O module using conventional techniques.

Next at step 128 characteristics of the working space as determined based on the sensor data from step 124 are compared to predetermined characteristics of the working space. Upon comparing the characteristics of the working space with the predetermined characteristics, the method moves to step 130.

If at step 130 the sensed characteristic of the working space is not less than the predetermined threshold characteristic, then no gas need be added to the accumulator 12 and the method moves back to step 124 and repeats. However, if the sensed characteristic of the working space is less than the predetermined threshold characteristic, then a replenish operation is performed at steps 132-136. Such process is described above with respect to steps 112-116 and therefore is not repeated here.

Although the principles, embodiments and operation of the present invention have been described in detail herein, this is not to be construed as being limited to the particular illustrative forms disclosed. For example, the illustrated mechanical gear set could alternatively include a planetary mechanical gear set. Also, the illustrated hybrid mechanism could alternatively include electric motors and generators and batteries and the operation of the vehicle body power equipment could be assisted by stored electrical energy. It will thus become apparent to those skilled in the art that various modifications of the embodiments herein can be made without departing from the spirit or scope of the invention.

What is claimed is:

1. A pressure accumulator, comprising:

an accumulator housing having first and second ports for receiving first and second pressure mediums, respectively;

a movable separating element subdividing an interior of the accumulator housing into at least first and second working spaces, the first working space accommodating the first pressure medium and the second working space accommodating the second pressure medium, wherein the first port is in fluid communication with the first working space and the second port in fluid communication with the second working space;

at least one sensor operatively coupled to the first working space for measuring at least one characteristic of the first working space;

a Nitrogen gas generator operative to generate a Nitrogen gas from a source of air, the Nitrogen gas generator including an outlet for outputting the generated Nitrogen gas, the outlet in fluid communication with the first port; and a controller operatively coupled to the at least one sensor and the Nitrogen gas generator, the controller configured to compare the at least one sensed characteristic to a predetermined threshold level of the characteristic, and based on the comparison generate a command to introduce Nitrogen gas from the Nitrogen gas generator into the first working space.

2. The accumulator according to claim 1, wherein the at least one sensor comprises a pressure sensor operative to measure a pressure of the first pressure medium in the first working space, and wherein the controller is configured to determine the rate at which the Nitrogen gas generator charges Nitrogen gas into the first working space based on a measured pressure of the Nitrogen gas in the first working space and a pressure of the Nitrogen gas output by the Nitrogen gas generator.

3. The accumulator according to claim 1, wherein said Nitrogen gas generator is mounted on said accumulator.

4. The accumulator according to claim 1, wherein the Nitrogen gas generator comprises a nitrogen scrubber operative to extract nitrogen from air.

5. The accumulator according to claim 1, wherein the Nitrogen gas generator comprises an intensifier operative to raise a pressure of the Nitrogen gas.

6. The accumulator according to claim 5, wherein the intensifier comprises a compressor.

7. The accumulator according to claim 1, wherein the controller is operatively coupled to the Nitrogen gas generator to provide the command to the Nitrogen gas generator to generate Nitrogen gas, and the Nitrogen gas generator is configured to be responsive to the command to generate Nitrogen gas and provide the generated Nitrogen gas to the outlet of the Nitrogen gas generator.

8. The accumulator according to claim 1, wherein the at least one sensor comprises at least one of a temperature sensor operative to measure a temperature of the first pressure medium, a pressure sensor operative to measure a pressure of the first pressure medium, or a position sensor operative to measure a position of the moveable separating element within the accumulator housing, and wherein the controller, based on data provided by the at least one sensor, is configured to calculate at least one of a volume of the first working space, a mass of the first pressure medium, a temperature of the first pressure medium, or a pressure of the first pressure medium.

9. The accumulator according to claim 1, further comprising a check valve between the accumulator and the Nitrogen gas generator.

10. The accumulator according to claim 1, wherein the at least one sensor comprises a pressure sensor operative to measure a pressure of the first pressure medium in the first working space.

11. The accumulator according to claim 1, wherein the at least one sensor comprises a position sensor operative to measure a position of the movable separating element within the accumulator housing, and wherein the controller is configured to calculate a volume of the first working space based on the measured position of the moveable separating element.

12. A pressure accumulator, comprising:

an accumulator housing having first and second ports for receiving first and second pressure mediums, respectively;

a movable separating element subdividing an interior of the accumulator housing into at least first and second working spaces, the first working space accommodating the first pressure medium and the second working space accommodating the second pressure medium, wherein the first port is in fluid communication with the first working space and the second port in fluid communication with the second working space;

at least one sensor operatively coupled to the first working space for measuring at least one characteristic of the first working space;

a Nitrogen gas generator operative to generate a Nitrogen gas from a source of air, the Nitrogen gas generator including an outlet for outputting the generated Nitrogen gas, the outlet in fluid communication with the first port; and a controller operatively coupled to the at least one sensor and the Nitrogen gas generator, the controller configured to calculate an amount of Nitrogen gas in the first working space based on the at least one characteristic, upon the calculated amount of Nitrogen gas in the first working space being below a first threshold level, generate a command to introduce Nitrogen gas from the Nitrogen gas generator into the first working space.

13. The accumulator according to claim 12, wherein the controller is configured to:

determine a deficiency of the Nitrogen gas in the first working space based on the calculated amount of Nitrogen gas in the first working space and a target amount of Nitrogen gas for the first working space;

determine a rate at which the Nitrogen gas generator charges Nitrogen gas into the first working space; and determine an amount of time to command the Nitrogen gas generator to introduce Nitrogen gas into the first working space based on the determined deficiency of the Nitrogen gas in the first working space and the determined rate at which the Nitrogen gas generator charges gas into the first working space.

14. A method for replenishing a pre-charge Nitrogen gas of an accumulator, the accumulator including a first working space for storing the pre-charge Nitrogen gas and a second working space for receiving a fluid, the method comprising:

sensing a pressure of the pre-charge Nitrogen gas in the first working space;

comparing the sensed pressure to a prescribed threshold pressure;

upon the sensed pressure being less than the prescribed threshold sensed pressure, using a Nitrogen gas generator to extract Nitrogen gas from the air, and charge the extracted Nitrogen gas into the first working space.

15. A method for replenishing a pre-charge Nitrogen gas of an accumulator, the accumulator including a first working space for storing the pre-charge gas and a second working space for receiving a fluid, the method comprising:

calculating a mass of the pre-charge Nitrogen gas in the first working space;

comparing the calculated mass to a prescribed threshold mass;

upon the calculated mass being less than the prescribed threshold mass, using a Nitrogen gas generator to extract a gas corresponding to the pre-charge Nitrogen gas from the air, and charge the extracted Nitrogen gas into the first working space.

16. The method according to claim 15, wherein comparing includes:

determining a deficiency in the amount of the Nitrogen gas in the first working space based on the calculated mass and a target mass for the Nitrogen gas in first working space;

determining a rate at which the Nitrogen gas generator charges the Nitrogen gas into the first working space; and determining an amount of time to activate the Nitrogen gas generator to charge the Nitrogen gas into the first working space based on the determined deficiency in the amount of the Nitrogen gas in the first working space and the determined rate at which the Nitrogen gas generator charges the Nitrogen gas into the first working space.

17. The method according to claim 16, wherein determining the rate at which the Nitrogen gas generator charges the Nitrogen gas into the first working space includes basing the rate on a measured pressure of the Nitrogen gas in the first working space and a pressure of the Nitrogen gas output by the Nitrogen gas generator.

18. The method according to claim 15, wherein determining the mass of the Nitrogen gas comprises:

determining a volume of the first working space;

measuring a pressure of the Nitrogen gas in the first working space;

measuring a temperature of the Nitrogen gas in the first working space; and determining the mass of the Nitrogen gas based on the determined volume of the first working space, the pressure of the Nitrogen gas in the first working space, and the temperature of the Nitrogen gas in the first working space.

* * * * *